US005494286A

United States Patent [19]

DeMar et al.

[11] Patent Number: 5,494,286

[45] Date of Patent: Feb. 27, 1996

[54] BALL ADVANCING DEVICE FOR A PINBALL GAME

[75] Inventors: Lawrence E. DeMar, Winnetka; Edward A. Estes, Wheaton; Brian R. Eddy, Addison; Patrick M. Lawlor, Marengo, all of Ill.

[73] Assignee: Williams Electronics Games, Inc., Chicago, Ill.

[21] Appl. No.: 315,556

[22] Filed: Sep. 30, 1994

[51] Int. Cl.[6] ..... A63F 7/34

[52] U.S. Cl. ..... 273/121 A; 273/121 R; 273/118 R; 273/118 A

[58] Field of Search ..... 273/118, 119, 273/121

[56] References Cited

U.S. PATENT DOCUMENTS 1,648,956 11/1927 Meade .
4,373,725 2/1983 Ritchie ..... 273/121 A
5,158,291 10/1992 Biagi et al. ..... 273/118 A
5,356,142 10/1994 Borg et al. ..... 273/121 A
5,358,242 10/1994 Trudeau et al. ..... 273/119 AX
5,375,829 12/1994 Lawlor et al. ..... 273/121 AX

*Primary Examiner*—Raleigh W. Chiu
*Attorney, Agent, or Firm*—Rockey, Rifkin & Ryther

[57] ABSTRACT

An electromagnet is mounted beneath the playfield. Sensors, such as optical switch pairs, are positioned on the playfield in operative relation with the electromagnet to detect the ball and to produce a signal in response thereto. The microprocessor, in response to such signals, briefly pulses the magnet to accelerate the ball or energizes the electromagnet for an extended period to grab and hold the ball. When the ball is held, the magnet is thereafter deenergized and briefly pulsed to propel the ball on the playfield. In one embodiment, a plurality of electromagnets are provided along a ball path which are operated sequentially by the game microprocessor to move the ball from magnet to magnet in a stepped manner.

13 Claims, 4 Drawing Sheets

BALL ADVANCING DEVICE FOR A PINBALL GAME

BACKGROUND OF THE INVENTION

The invention relates, generally, to pinball games and, more particularly, to a ball advancer for such games. Pinball games typically include an inclined playfield supporting a rolling ball and a plurality of play features such as ramps, targets, bumpers and the like. The player manipulates flippers mounted on the playfield to direct the ball at selected play features thereby to control play of the game.

Because the popularity of a manufacturer's line of games depends on its ability to produce new and interesting play features, numerous play features for pinball games have been designed to control the movement of the balls over the playfield. For example, U.S. Pat. No. 5,158,291 discloses a ball accelerator that uses electromagnetic coils to accelerate a ferromagnetic ball in a pinball game. U.S. Pat. No. 4,848,748 discloses a ball lifter for a pinball game that uses a magnet propelled by a reversing screw to transfer the ball from the inclined playfield to a second vertical playfield.

In addition to these devices, other amusement games have also used magnets to alter the travel of the ball on the playfield. For example, in baseball-type amusement games, player controlled electromagnets mounted below the playfield have been used to create a "curve ball". Pinball games have also used magnets mounted below the playfield to make a ball travel across the playfield to permit a player to try and knock the ball off of the magnets to create multiple ball play as disclosed in application Ser. No. 08/079,074, filed Aug. 5, 1993, assigned to the present assignee.

A player controlled electromagnet has been used adjacent the drain lanes to prevent a ball from entering the drain hole (see U.S. Pat. No. 4,373,725). In this play feature, the magnet is energized for an extended period when the player presses a button thereby to stop and hold the ball. Also, a player controlled electromagnet has been used to redirect and propel a pinball toward targets provided in an area associated with the playfield as disclosed in application Ser. No. 08/021,223, filed on Feb. 23, 1993, assigned to the present assignee.

While numerous play features have been developed to control the movement of a pinball, none have used a processor controlled electromagnet for precise movement of the ball across the playfield in a pre-determined and controlled manner for pure entertainment purposes.

SUMMARY OF THE INVENTION

In its simplest form, the invention comprises a single electromagnet mounted to the inclined playfield. Sensor pairs, such as optical switches, are mounted on the playfield above and below the electromagnet. When a ball is detected near the electromagnet on the playfield, one of the sensors operatively associated therewith generates a signal which is sent to the game microprocessor. For example, the first sensor pair detects a pinball below the electromagnet while the second sensor pair detects a pinball which is above the electromagnet. In response to either signal, the microprocessor energizes the electromagnet for a predetermined period of time to stop and hold the ball on the electromagnet.

To release and propel a held ball, the electromagnet is de-energized and quickly re-energized for a brief pulse to propel the ball in a direction opposite the incline of the playfield. Instead of holding a ball which is delivered to the electromagnet, the electromagnet can be utilized to accelerate the ball. In this case, the microprocessor briefly pulses the electromagnet to accelerate the pinball when one of the sensor pairs detects the pinball rolling toward the electromagnet.

In a second embodiment of the invention, a plurality of electromagnets are provided along a desired path of travel of the ball. For example, the electromagnets can be located along a ball lane such that any magnet can be energized to stop and hold a ball travelling in the ball lane. If the electromagnets are operated sequentially by the game microprocessor, the balls are moved from magnet to magnet in a stepped manner which is quite entertaining to game players.

DETAILED DESCRIPTION OF THE INVENTION

Figure 1:
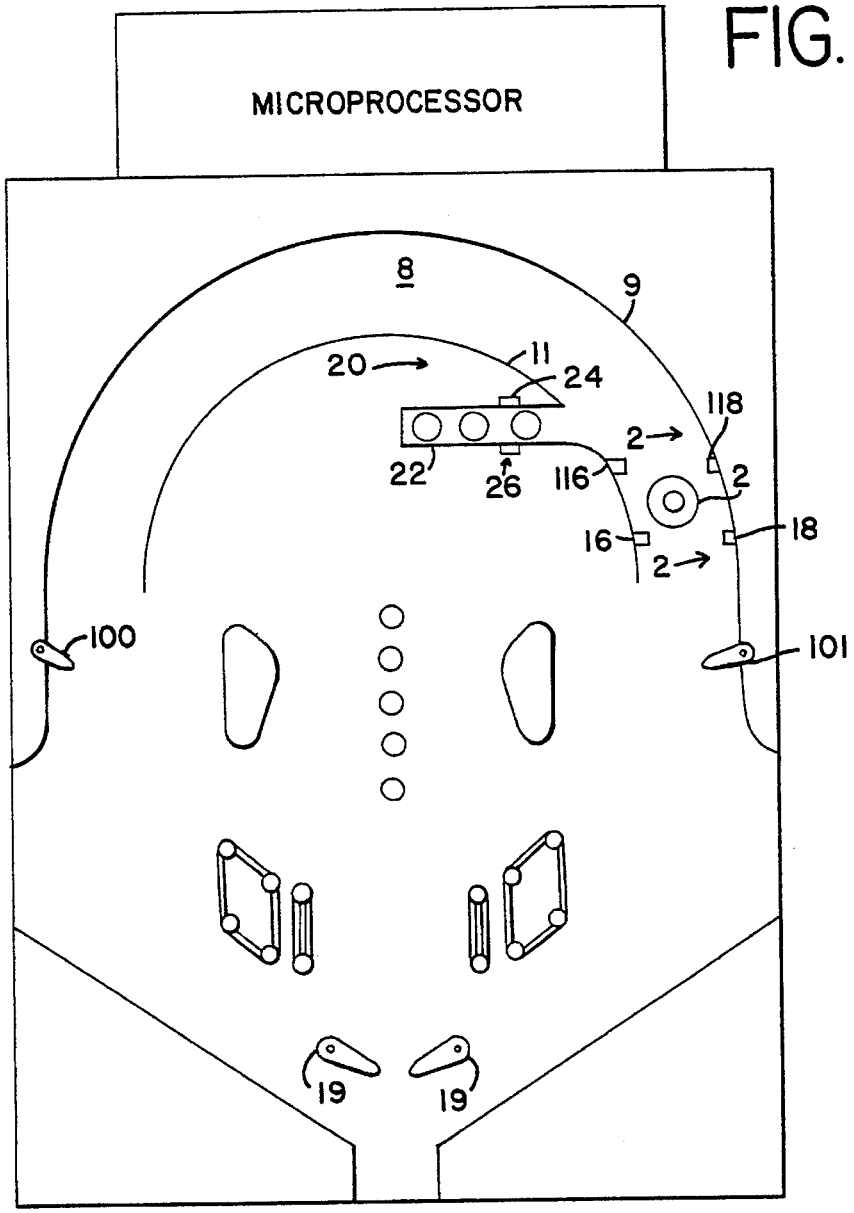
FIG. 1 is a top view of a first embodiment of the invention.
Figure 2:
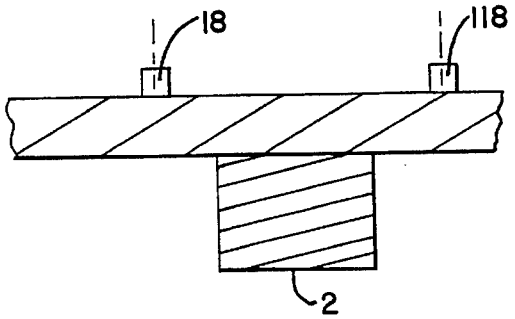
FIG. 2 is a section view of the first embodiment of the invention taken along line 2—2 of FIG. 1.
Figure 2A:
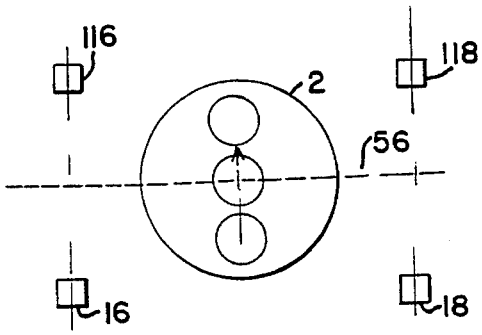
FIG. 2*a* is a top view useful in illustrating the operation of the invention.

Referring more particularly to FIGS. 1, 2 and 2*a*, the first embodiment of the invention includes a single electromagnet mounted beneath the playfield. In the illustrated embodiment, electromagnet 2 is mounted beneath the surface of playfield 1 and is arranged in a lane along a path of travel of a ferromagnetic ball. As illustrated, the electromagnet 2 is situated in curved lane 8 which is defined by walls 9 and 11.

It should be noted that playfield 1 is inclined such that a ball which is centrally disposed over electromagnet 2 and released will roll downwards to a position below the electromagnet on the playfield. Force must thereafter be applied by the magnet to project the pinball upwardly to a position above the electromagnet.

Operatively associated with electromagnet 2 are first and second sensors for detecting a ball in proximity therewith and for producing a signal in response thereto. Preferably, an optical switch pair having a light source 16 and a detector 18, such as an LED and a photo-transistor, are used for the sensors although any suitable ball sensor can be used.

The first sensor is positioned slightly below the electromagnet and the second sensor is positioned slightly above the electromagnet on the playfield. More specifically, referring to FIG. 2*a*, the first sensor pair 16, 18 is positioned below the centerline 56 of electromagnet 2 and the second sensor pair 116, 118 is positioned above centerline 56 such that a ball can be optimally propelled as explained in detail hereafter.

A ball feeder 20, which is mounted on the playfield above electromagnet 2, is provided for delivering a ball to electromagnet 2. Balls are delivered to feeder 20 via a ball delivery system (not shown) mounted beneath the playfield or by any suitable mechanism. Ball feeder 20 includes a chute 22 for retaining at least one ball and a kicker 24 for delivering a ball from chute 22 to the playfield in the direction of electromagnet 2.

The kicker 24 can be actuated by a solenoid (not shown) controlled by the game microprocessor. A sensor 26, such as an optical switch, is provided to deliver a signal to the game microprocessor indicating that a ball is in chute 22. While a specific ball feeder is illustrated, it will be understood that a ball can be delivered to electromagnet 2 by any suitable mechanism or by the player using the game flippers 19 or by a shot from playfield flippers 100 and 101.

The operation of electromagnet 2 will now be described with reference to FIGS. 2*a*, 3*a*–3*c* and 4*a*–4*c*. When a ferromagnetic ball is delivered to electromagnet 2, the electromagnet is energized, and the ball is stopped and held in the position of FIGS. 3*a* and 4*a* for as long as desired.

In the case of a ball arriving from below the magnet, a signal is sent to the microprocessor to energize electromagnet 2 when the ball interrupts the switch pair 16, 18. When a pinball approaches the magnet from above, switch pair 116, 118 signals the microprocessor to energize electromagnet 2. Alternatively, electromagnet 2 can be automatically energized when a ball is ejected from chute 22.

Figure 3A:
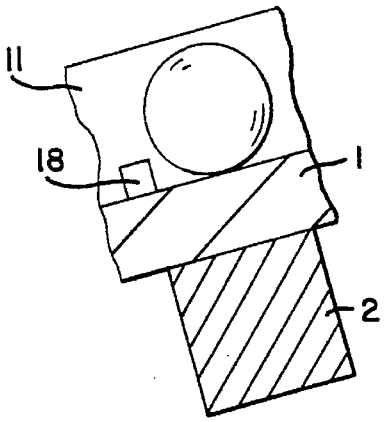
FIGS. 3*a*–3*c* are side views showing the sequence of operation of the invention.
Figure 3B:
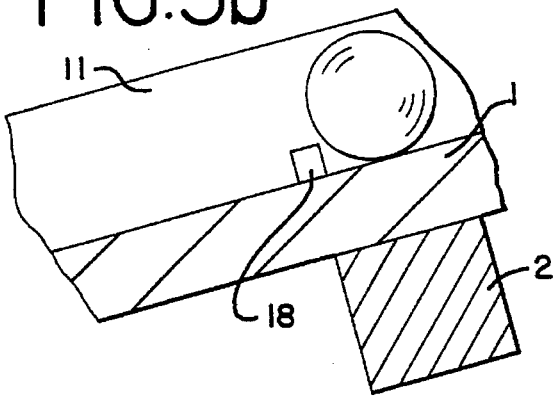
Figure 3C:
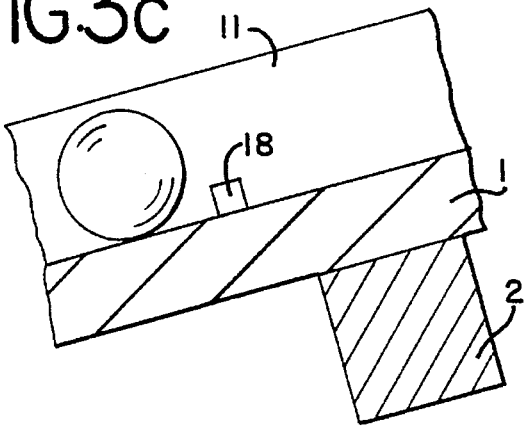
Figure 4A:
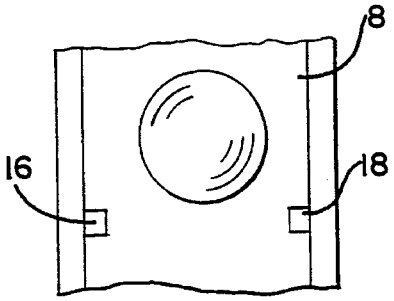
FIGS. 4*a*–4*c* are top views showing the sequence of operation of the invention.
Figure 4B:
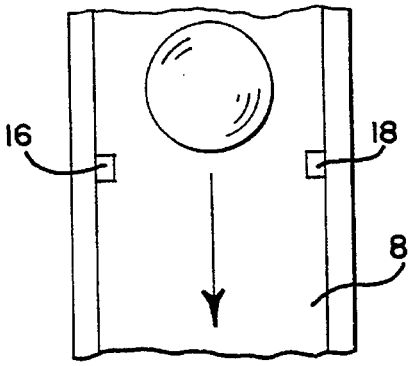
Figure 4C:
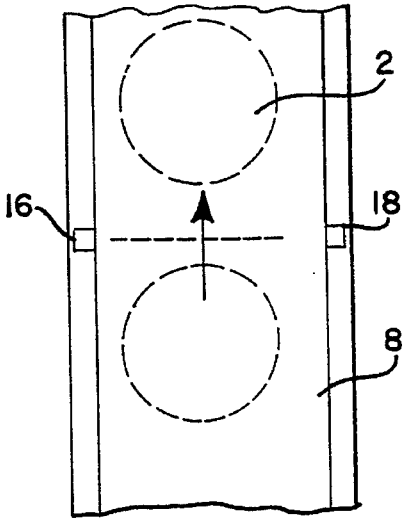

To propel a ball which is held over electromagnet 2, the magnet is briefly de-energized to permit the ball to roll toward the player, due to the incline of the playfield, as shown by the arrow in FIGS. 3*b* and 4*b*. The ball moves to a position where it interrupts the switch pair 16, 18. The game microprocessor then re-energizes electromagnet 2 for a short pulse which is selected to terminate when the pinball is approximately centered over the electromagnet.

Typically, the pulse duration is on the order of 32 milliseconds for a sensor which is located just below the electromagnet. Energizing the electromagnet in this manner causes the ball to be attracted toward the center of the electromagnet as shown by the arrow in FIGS. 2*a*, 3*c* and 4*c*. Because the electromagnet is de-energized when the ball is approximately centered over the magnet, ball velocity is maintained thereby propelling the ball beyond the magnet.

Instead of holding a ball over electromagnet 2, the sensors can be used to signal the game microprocessor to briefly pulse electromagnet 2 to accelerate a ball. In this case, if the ball approaches magnet 2 from above, then it will be accelerated downwardly. If the ball approaches from below, the ball will be accelerated upwardly. In this mode, the electromagnet 2 is pulsed as soon as the ball interrupts the appropriate sensor with the pulse terminating when the ball is centered over electromagnet 2 as previously discussed.

Figure 5:
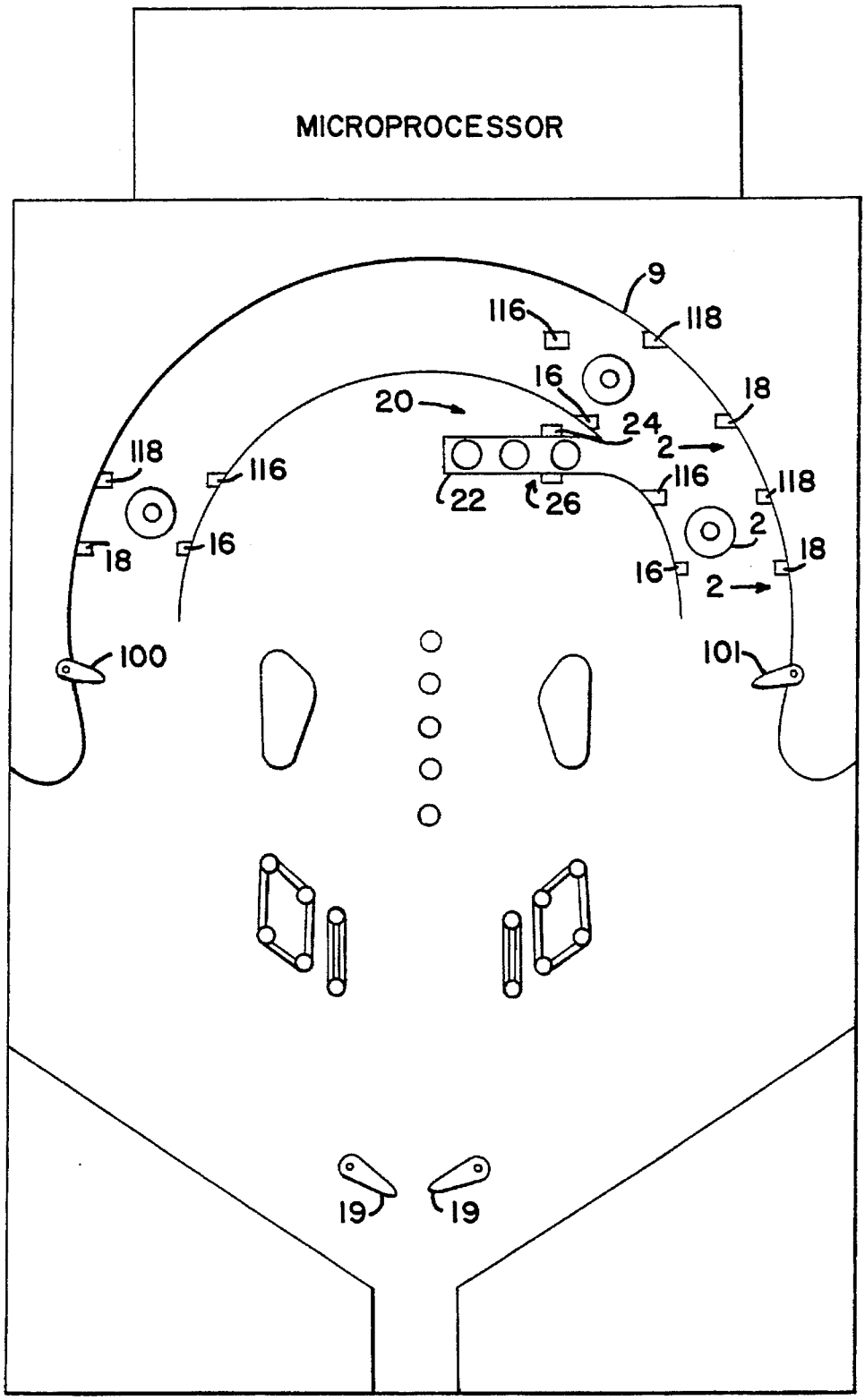
FIG. 5 is a top view of a second embodiment of the invention.

FIG. 5 is a top view of a second embodiment of the invention in which three electromagnets 2, 4, and 6 are mounted beneath playfield 1. In the illustrated embodiment, the electromagnets are arranged in curved lane 8 which is defined by walls 9 and 11. It will be appreciated that fewer or a greater number of electromagnets could be used, if desired. Sensor pairs 16, 18 and 116, 118 are operatively associated above and below each electromagnet as discussed with reference to the first embodiment of the invention.

A principal benefit of the second embodiment of the invention is the ability to provide an entertaining display of ball control. The result is a "dancing ball" feature which is quite striking in appearance. It is unique in that the ball is precisely controlled as it moves to and stops at each location, without player intervention. As will be apparent, any number of electromagnets can be used to increase the visual effect, a pinball can be propelled between the magnets in any predetermined sequence.

In operation, the ball advancer can be selected by the game microprocessor when, for example, the player achieves a predetermined game objective. Then, a ferromagnetic ball is delivered to and held by a first magnet 2. Magnet 2 can be controlled to first hold and then to propel a ball toward a second magnet 4. When a ball is propelled towards magnet 4 and activates that magnet's sensor pair 16, 18, magnet 4 is energized to stop and hold the ball. Magnet 4 is then controlled as previously explained to propel the held ball toward a magnet 6. The process is repeated for all of the magnets until the ball is discharged back onto the playfield.

The ball advancer of the invention can also be used with multiple balls. In this mode of operation, feeder 20 is filled with a plurality of balls. The first ball is delivered to magnet 2. It is held and then, after a delay, fed from magnet 2 to magnet 4 as previously described. With magnet 2 now empty, a second ball is delivered to magnet 2 where it is then held.

The two balls are then conveyed from magnets 2 and 4 to magnets 4 and 6, respectively, such that magnet 2 is again empty. A third ball is then delivered to magnet 2 such that each magnet retains one of the balls. The balls can then be ejected from the play feature by firing all three magnets simultaneously, or in any combination such as releasing magnet 6, then delay-firing magnet 4 and magnet 2 to propel these balls around the top.

Figure 6:
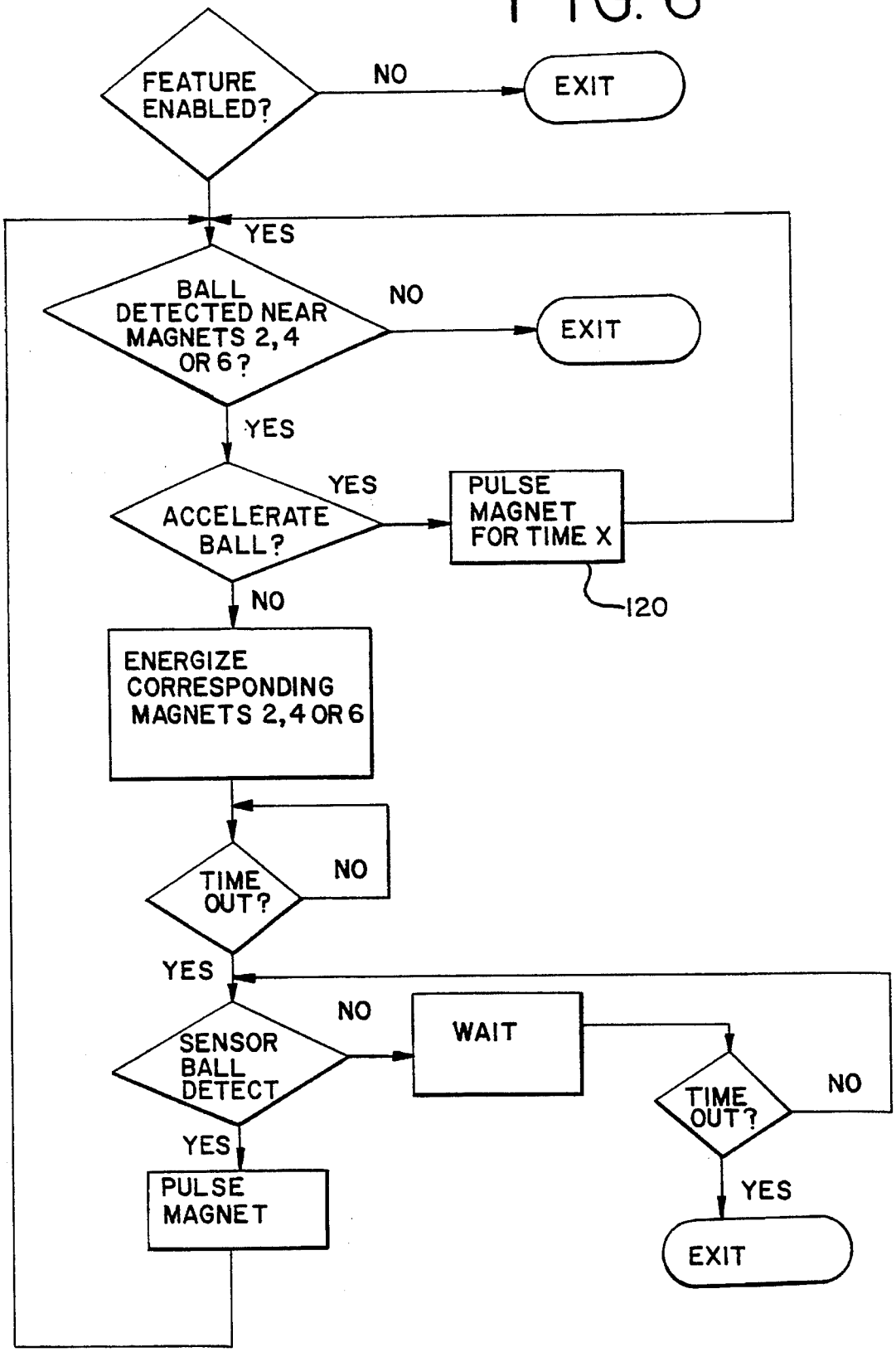
FIG. 6 is a flow diagram of a program for use with the invention.

FIG. 6 illustrates a simplified flow diagram of the functions required of a control program to implement the play feature of the invention. Referring to FIG. 6, the processor determines, according to the rules of the particular game, if the feature is enabled and exits if it is not. If a ball has not been detected near the electromagnets, the routine ends. When a ball has been detected, it can be accelerated, if desired, step 120. If so, the processor briefly energizes the magnet. If not, then the magnet is energized for a predetermined amount of time as determined by the game rules and the effect which is desired.

After the magnet is deenergized and when the sensor associated with the magnet is operated, the game microprocessor energizes the magnet for a short pulse thereby propelling the ball along a linear path. If the sensor does not detect the ball after a predetermined amount of time due to system malfunction, for example, the routine ends. After the magnet is pulsed, the ball either is propelled to the next magnet or toward a desired location on the playfield. The routine is repeated when the propelled ball activates an optical switch pair of another magnet, if the feature is enabled for that magnet.

While the invention was described in some detail with respect to the drawings, it will be appreciated that numerous changes in the details and construction of the device can be made without departing from the spirit and scope of the invention.

What is claimed is:

1. In combination, a play feature for moving a ferromagnetic pinball in a predetermined manner and an inclined playfield, the combination comprising:

a) an inclined playfield;

b) an electromagnet mounted flush with or below the level of the playfield;

c) sensor means associated with said electromagnet for detecting the presence of said pinball; and d) microprocessor means responsive to said sensor means, for (i) energizing said electromagnet for a sufficient time to attract and hold said pinball; (ii) briefly deenergizing said electromagnet to permit the ball to begin to roll away from the electromagnet in the direction of the playfield incline; and (iii) subsequently briefly re-energizing said electromagnet thereby to propel it in the direction opposite the incline of the playfield.

2. The combination of claim 1 wherein said sensor means is positioned slightly down the inclined playfield from said electromagnet to detect the ball rolling away.

3. A play feature for a pinball game having an inclined playfield and at least one ferromagnetic pinball comprising:

a) an electromagnet adapted to be operatively mounted to the playfield;

b) sensor means associated with said electromagnet for detecting the presence of said pinball in proximity with the electromagnet; and c) microprocessor means, responsive to said sensor means, for selectively energizing and deenergizing said electromagnet in a predetermined sequence to first attract and hold said pinball and thereafter to propel it away from the electromagnet.

4. The play feature of claim 3 wherein said sensor means is adapted to be positioned on said playfield to detect a ball rolling away from said electromagnet.

5. The play feature of claim 4 wherein detection of the ball rolling away signals the microprocessor means to briefly pulse said electromagnet to propel the ball in a desired direction.

6. The play feature of claim 3 wherein the sensor means is an optical switch pair.

7. The play feature of claim 6 wherein said optical switch pair is adapted to be positioned on said playfield below said electromagnet.

8. A play feature for a pinball game having an inclined playfield and at least one ferromagnetic pinball comprising:

a) a plurality of electromagnets adapted to be located in operative relation along a defined path on said playfield;

b) sensor means associated with each electromagnet for detecting the presence of a ball in proximity thereto; and c) microprocessor means, responsive to said sensor means, for selectively energizing and deenergizing the electromagnets in a predetermined sequence to hold and then propel the balls along said path in a stepwise fashion, whereby a ball is passed from electromagnet to electromagnet.

9. The play feature of claim 8 wherein said predetermined sequence includes briefly deenergizing an electromagnet holding a ball to permit the ball to roll away from the corresponding electromagnet and subsequently briefly re-energizing the electromagnet to propel the ball to the next electromagnet along said path.

10. The play feature of claim 9 wherein each of said sensor means is positioned relative to said electromagnets to detect the ball rolling away therefrom.

11. The play feature of claim 8 wherein said sensor means are optical switch pairs.

12. The play feature of claim 8 wherein said predetermined sequence includes briefly energizing an electromagnet upon the approach of a ball thereto to accelerate the ball in a desired direction towards a desired location.

13. The play feature of claim 12 wherein said sensor means includes first and second sensors for detecting a ball below and above the corresponding electromagnet thereby to accelerate the ball.

* * * * *